US007854645B2

(12) United States Patent
Kiontke et al.

(10) Patent No.: US 7,854,645 B2
(45) Date of Patent: Dec. 21, 2010

(54) METHOD FOR POLISHING

(75) Inventors: Sven Kiontke, Jena (DE); Thomas Kurschel, Dorndorf-Steudnitz (DE)

(73) Assignee: asphericon GmbH, Jena (DE)

( * ) Notice: Subject to any disclaimer, the term of this patent is extended or adjusted under 35 U.S.C. 154(b) by 0 days.

(21) Appl. No.: 11/729,799

(22) Filed: Mar. 30, 2007

(65) Prior Publication Data

US 2007/0173176 A1 Jul. 26, 2007

Related U.S. Application Data

(63) Continuation of application No. PCT/DE2005/001712, filed on Sep. 28, 2005.

(30) Foreign Application Priority Data

Sep. 30, 2004 (DE) ..... 10 2004 047 563

(51) Int. Cl.
*B24B 51/00* (2006.01)

(52) U.S. Cl. ..... 451/5; 451/42

(58) Field of Classification Search ..... 451/42, 451/256, 255, 5

See application file for complete search history.

(56) References Cited

U.S. PATENT DOCUMENTS 5,341,604 A * 8/1994 Wood ..... 451/5
6,276,994 B1 * 8/2001 Yoshida et al. ..... 451/41
6,733,369 B1 5/2004 Stacklies et al.
6,796,877 B1 * 9/2004 Bingham et al. ..... 451/5
2004/0229553 A1 11/2004 Bechtold et al.

FOREIGN PATENT DOCUMENTS

| | | | |
|---|---|---|---|
| DE | 697 27 275 | T2 | 4/1998 |
| DE | 100 31 057 | A1 | 1/2002 |
| DE | 101 06 007 | A1 | 8/2002 |
| EP | 0 727 280 | A1 | 8/1996 |
| EP | 0 835 722 | A1 | 4/1998 |
| EP | 0 685 298 | B2 | 8/2002 |

* cited by examiner

*Primary Examiner*—Robert Rose
(74) *Attorney, Agent, or Firm*—Muncy, Geissler, Olds & Lowe, PLLC

(57) ABSTRACT

A method is disclosed, whereby a reduced wear of the polishing tool and a reduced duration for the polishing process may be achieved and also free form surfaces and non-rotating workpieces may be polished. The above may be achieved whereby the surface of the tool actually in contact with the workpiece lies off the tool axis. The invention further relates to a method for polishing a surface of a workpiece, via a tool rotating about a tool axis, whereby the workpiece, at least in one region of the workpiece surface has a contacted surface which is part region of a surface for machining, which for its part is at least part of a polishing surface of the tool, whereby the tool axis intersects the polishing surface.

2 Claims, 7 Drawing Sheets

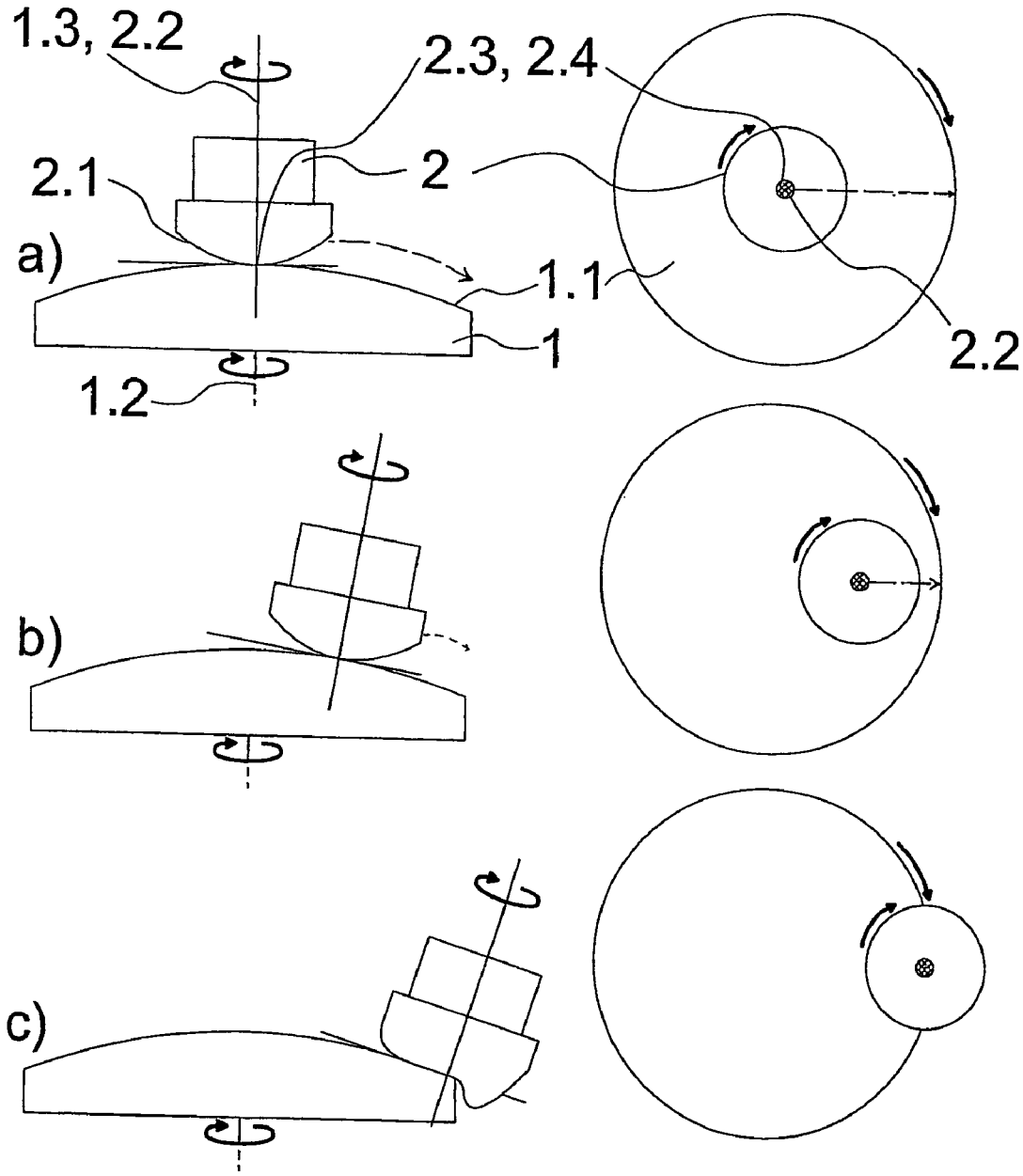
Fig. 1 - (CONVENTIONAL ART)
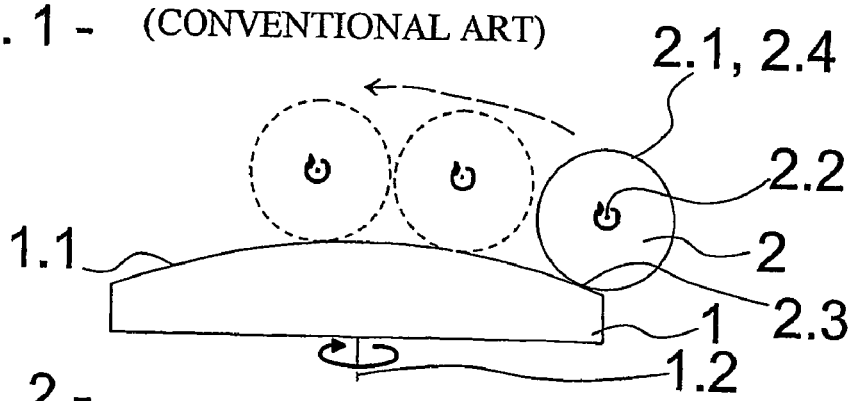
Fig. 2 - (CONVENTIONAL ART)

METHOD FOR POLISHING

This nonprovisional application is a continuation of International Application No. PCT/DE2005/001712, which was filed on Sep. 28, 2005, and which claims priority to German Patent Application No. DE 102004047563, which was filed in Germany on Sep. 30, 2004, and which is herein incorporated by reference.

BACKGROUND OF THE INVENTION

1. Field of the Invention

The present invention relates to a method for polishing a surface of a workpiece, by means of a tool rotating about a tool axis, whereby the workpiece is contacted in at least one region of the workpiece surface by a respective momentarily contacting surface that is a subarea of a surface for machining, which for its part is at least part of a polishing surface of the tool, whereby the tool axis intersects the polishing surface.

2. Description of the Background Art

Below, the term surface for machining may denote the entirety of all surfaces of a rotating tool touching the workpiece during a revolution of the tool. The momentarily contacting surface may be referred to as the surface that is in contact with the workpiece at a respective point in time.

In the conventional art according to FIG. 1, a rotating tool 2 is moved on a likewise rotating workpiece 1, whereby the rotating tool 2 is composed of a rubber membrane or a pestle with a glued-on polyurethane membrane, e.g., a polishing foil or polishing surface 2.1. The tool rotates about a tool axis 2.2, the workpiece rotates about a workpiece axis 1.2. The polishing foil exhibits a curvature and rests with it's rotational center and a circular machining area 2.4 around the rotational center on the workpiece 1 during the machining. Thereby the polishing foil is being pressed on, e.g. by compressed air or a deforming elastomer. Removal at the workpiece is achieved by the polishing foil as well as by a permanently fed liquid. The membrane or the pestle is always placed perpendicularly onto the workpiece surface 1.1 and slowly guided on a radius over the workpiece 1 by means of a CNC program. The sub figures *a*), *b*) and *c*) show discrete points in time of such a motion in a lateral view as well as in a top view, respectively. The removal is controlled by choosing the speed profile on the radius in order to achieve the desired shape of the workpiece 1.

This method, however, only yields a small amount of removal. Moreover, the polishing tool is worn out comparatively fast. Furthermore for polishing the border area the tool has to protrude at least partially over the workpiece as depicted in FIG. 1*c*). In doing so the tool can be very strongly worn out and destroyed by the lenses outer edge, especially at high air pressure. This method is suitable for convex or concave rotationally symmetric workpieces only, but not for free-form surfaces or non-rotating workpieces.

In another method, depicted in FIG. 2 a wheel-shaped polishing tool 2 rotating about a tool axis 2.2 is guided over a workpiece surface 2.1 of a workpiece 1 rotating about a workpiece axis 1.2. The polishing surface 2.1 is mounted on the contact surface of the wheel-shaped polishing tool 2, in this case. The entire polishing surface 2.1 acts as a machining surface 2.4 whereby only one momentarily contacting surface 2.3 is in contact with the workpiece surface 1.1 at every point in time. However there is a risk for polishing a hole in the center of the workpiece because of the small area machined there.

The machining precision of both methods, however, is limited.

SUMMARY OF THE INVENTION

It is therefore an object of the present invention to provide a method to reduce the wear of the polishing tool or decrease the duration of the polishing process, whereby free-form surfaces and non-rotating workpieces can be polished as well.

The method according to the invention allows for achieving a reduced wear of the polishing tool and/or an accelerated polishing process, whereby free-form surfaces and non-rotating workpieces can be polished. This is achieved by polishing with a polishing tool, whose rotational axis intersects the polishing surface, with an area of the polishing surface remote from the tool's rotational axis. The machining surface and the momentarily contacting surface are thus not identical in most cases. The momentarily contacting surface is rather a subset of the machining surface.

By contrast in the conventional method depicted in FIG. 1, the polishing is done with the central subarea around the rotational axis of the polishing tool only, which leads to a minimized machining surface. Thus, the machining surface and the momentarily contacting surface are identical at any point in time in the polishing process.

A center of the partial surface of the polishing surface, according to an embodiment of the present invention, is momentarily in contact with the workpiece and is advantageously apart from the rotational axis of the tool in the polishing method according to the invention, which leads to usage of an enlarged machining surface for polishing. With a larger distance of the center of the momentarily contacting surface to the rotational axis the machining surface is an annulus on the polishing surface. With a small distance it is a circle whose diameter increases with the distance.

The farther the momentarily contacting subsurface is radially away from the rotational axis the larger is the machining surface in its entirety and the higher is, at the same angular velocity, the track speed of the machining surface, thereby determining a duration of the polishing process. At the same rotational frequency, which is used with conventional polishing methods the duration of the polishing process is reduced. If the rotational frequency is chosen so that the track speed of the machining surface roughly equals the track speed of the conventional method, wear is noticeably reduced due to the enlarged surface and the tool lifetime is consequently increased. The tool needs less downtime by maintaining the required precision for a longer time and consequently has only to be replaced after a prolonged period of use compared to the conventional methods which leads to a higher productivity. The prolonged lifetime of the tool allows for a better prediction of the polishing process and thus for its higher precision. Furthermore the method according to the invention allows for an efficient polishing of border areas of lenses with a reduced risk for destroying the polishing tool.

Downtimes of the production process are reduced by prolonged lifetime of the tools.

Additionally the precision of the polishing is increased by a more uniform speed distribution over the machining surface which leads to less errors. In the conventional method according to FIG. 1 the center of the polishing surface as a pivot point is stagnant, while the outer edges of the machining surface are moving with speeds contrary to each other which makes a precise machining more difficult.

Due to the technically limited rotational frequency of the tool, small tools and even bigger tools achieving a removal a multiple bigger than that of the conventional method can be applied more efficiently, particularly with smaller workpieces having stronger curvatures for the most part.

Depending on the geometrical configuration of the workpiece it is appropriate to polish at least partially in the conventional manner by means of the rotational center of the polishing surface since the removal is the lowest here due to the low track speed which allows for a higher machining precision in particular in the center of the workpiece.

Below the term vertical may refer to the directions that are parallel to the workpiece axis.

An off-the-shelf polishing machine can be applied for implementing the method if the tool is being tilted in the polishing machine, whereby a relative angle between the tool axis and a local surface normal of the workpiece in the contacted area is adjusted. The method can be applied for convex and concave workpieces as well as for free-form surfaces like toroids or cylinder surfaces. Various types of tools are possible, for example, conical, drum-shaped, spherical and aspherical. Established polishing machines only exhibit a limited absolute tilting angle to the vertical for tilting the tool, e.g. less than 46°. Workpiece surfaces with slopes bigger than this maximum angle cannot be machined using the customary method. Using the method according to the invention surfaces with an arbitrary slope can be polished with a sufficiently curved tool with a slight tilting angle of the tool.

In an embodiment, a relative angle of more than 0° can be adjusted, whereby a polishing with the center of the polishing surface and the associated drawbacks are thereby avoided.

In another embodiment, the tool can be tilted about an axis running perpendicular to the tool axis which can very easily be achieved by means of a CNC program since tilting in such a direction is feasible with off-the-shelf polishing machines.

The workpiece can be rapidly machined in one pass by translatively moving the tool along at least one part of the workpiece surface.

In an embodiment, the relative angle can be continuously modified in the course of the motion along the workpiece surface. Thus the removal can be adapted to the machined surface of the workpiece.

In the interior area where the machined surface is small, the relative angle is adjusted to 0° for minimum removal, for instance. In the exterior area the relative angle is being increased to obtain the maximum removal there. Thus, compared to the customary method, there is no risk for polishing a hole in the center due to the small machined surface. Moreover the tool is worn uniformly this way.

The method can be optimally adapted to the respective application by determining the relative angle to be adjusted based on data of the workpiece or of the tool. In an embodiment, the relative angle can be determined based on the respective position of the tool relative to the workpiece and/or based on a surface normal of the workpiece in this position and/or based on a polishing surface normal of the momentarily contacting surface of the tool and/or based on a removal to be achieved. This allows for a high machining precision.

In an embodiment, the absolute tilting angle of the tool relative to the vertical can be kept constant during the translative motion. In this extreme case the tool is not tilted at all. For this purpose the tool has to meet the mechanical preconditions, in particular sufficiently steep slopes at its edge in order to be able to touch the workpiece in every slope on the surface of the workpiece. Thus the contact surface can be well predetermined. A kind of method can be programmed with particularly low effort in which the absolute tilting angle of the tool relative to the vertical is kept at 0° during the translative motion. This alternative is applied in favor if the workpiece and the tool exhibit an identical shape.

In general the relative angle can also be adjusted variably in such a way that the turning radiuses of the machined surface on the workpiece and of the machining surface on the tool always match. When a point on the workpiece with a certain radius is being machined the tool is tilted so that the machining area of the polishing surface exhibits the same radius. This is for instance implicitly the case if the shapes of the workpiece and of the tool are equal and if the absolute tilting angle of the tool relative to the vertical is constantly 0°. Thus a uniform wear of the tool is made possible and the removal caused by the track speed with the rotating workpiece is optimally adapted to the machined surface.

In another embodiment, the relative angle can be kept constant in the course of the motion. Though the tool wear is not reduced as much as with the continuously modified relative angle, but the removal of the workpiece is more uniform and thus better calculable in terms of a correcting polishing.

For machining of concave lenses as extensively as possible a convex polishing surface can be advantageously used and vice versa.

Convex workpieces can be machined by means of conventional polishing machines using the method according to the invention by tilting a tool with a planar polishing surface about an axis distinct from the tool axis depending on a surface normal of the workpiece in the contacted area, whereby the tool axis of the tool is collimated to the surface normal and the tool is translated parallely to a workpiece surface in the contacted area.

In an embodiment, the amount of the translation is determined on the basis of a removal to be achieved thus increasing the precision of the polishing.

With rotationally symmetrical workpieces the control of the workpiece is easy if the workpiece rotates about a workpiece axis. The polishing process can be accelerated if the rotary motions of the workpiece and tool are directed reversely to each other. The reverse track speeds of the machined surface and the machining surface allow a higher removal.

In order to increase the removal, the tool can be pressed against the workpiece surface. In doing so, the removal is adjustable if the contact pressure is controllable. In case the polishing surface is spoiled, the workpiece will not be damaged if the contacting pressure is generated by compressed air.

Using the method for polishing optically effective surfaces according to the invention, allows for utilizing the aforementioned advantages for optically effective surfaces, such as lenses or mirrors.

Rotationally symmetrical lenses can be machined using this method with particularly little effort.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein:

FIGS. 1*a-c* illustrates a polishing method of the prior art with a constant relative angle of 0°;

FIG. 2 shows a polishing method of the prior art with a tool axis parallel to the polishing surface;

DETAILED DESCRIPTION

FIGS. 1 and 2 have been described herein above.

Figure 3:
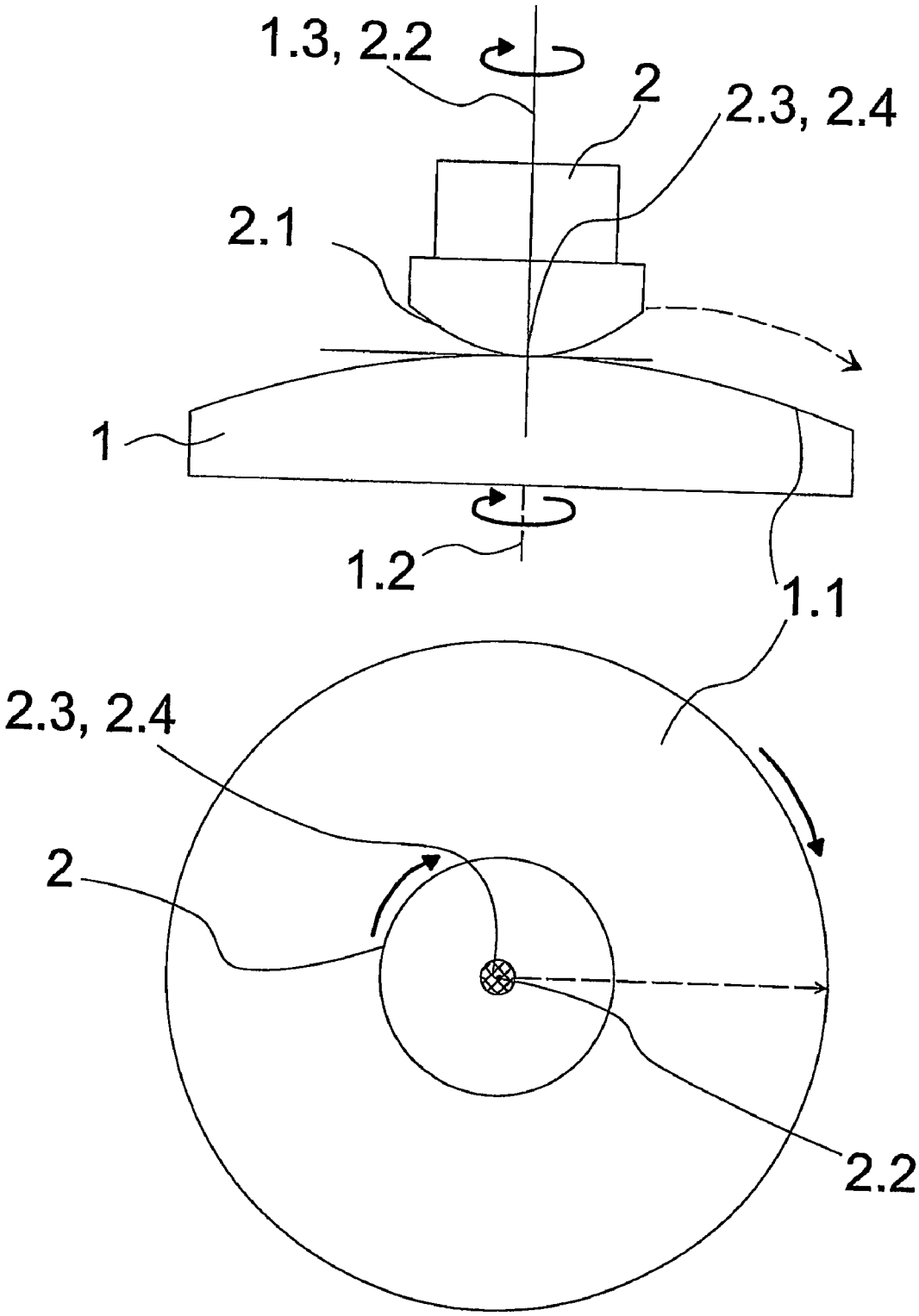
FIGS. 3*a-c* phases of the method according to the invention with a variable relative angle as well as schematic diagrams of the polishing surface and the machining surface, respectively in a lateral view and a top view.
Figure 3:
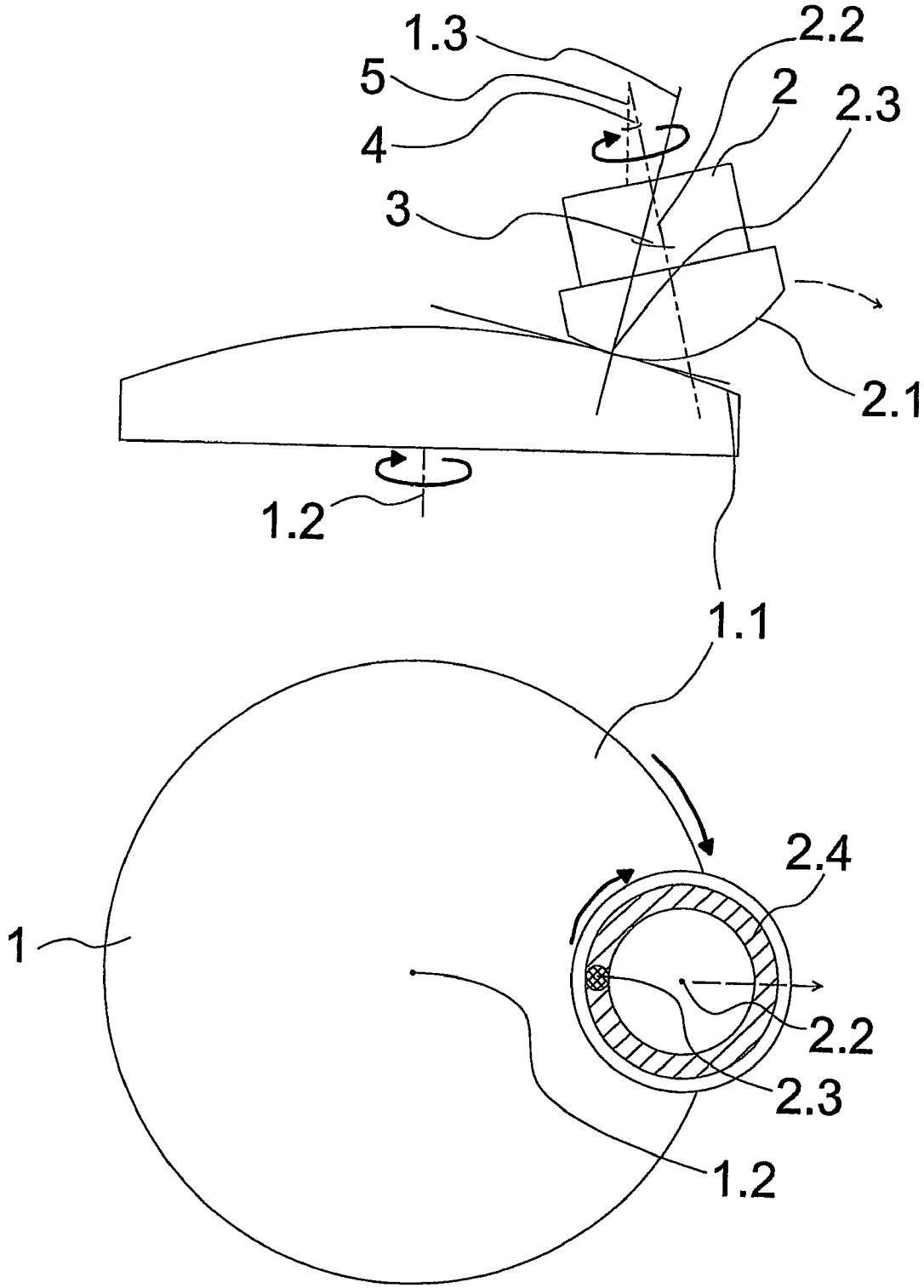
Figure 3:
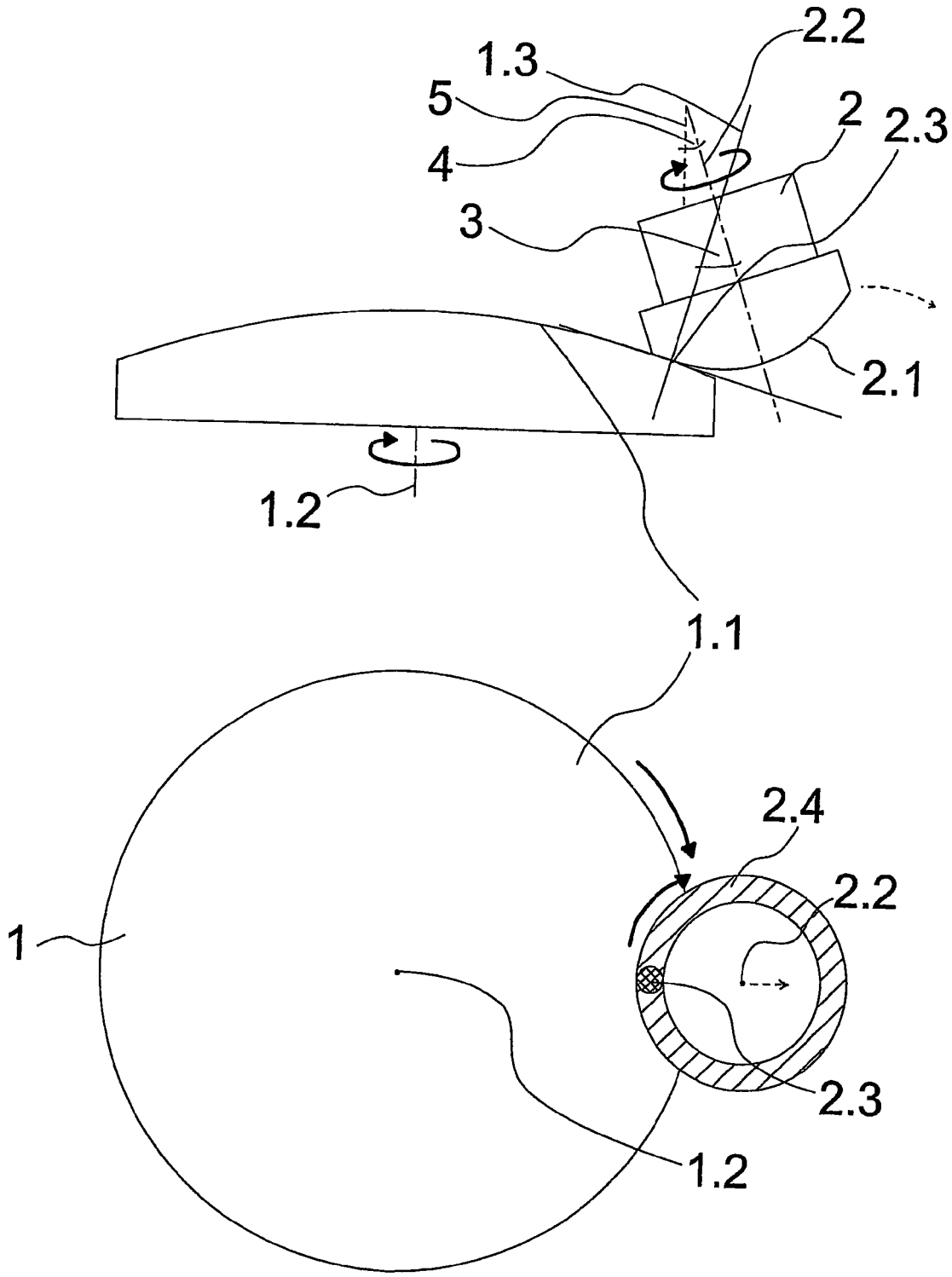

In FIG. 3 and its sub figures *a*), *b*) and *c*), each one showing a lateral view as well as a schematic top view, a workpiece 1, a lens in this case, with an aspherical surface 1.1 is polished by a tool 2 rotating about a tool axis 2.2. The three sub figures show different points in time during the polishing process. The workpiece 1 rotates about a workpiece axis 1.2, whereby the rotational directions on the side of the workpiece 1 facing the tool 2 are directed reversely to each other, the vectors of the angular speed are thus parallel to each other. The tool 2 contacts the workpiece 1 with a momentarily contacting surface 2.3, respectively which is part of a polishing surface 2.1, whereby the machining surface 2.4 on the polishing surface 2.1 results from the rotation of the tool 2 from the combination of all momentarily contacting surfaces 2.3. The shape of the machining surface 2.4 depends on the position of the tool 2. The polishing surface 2.1 is charged with an air pressure on a side turned away from the workpiece 1 such that it is being pressed against the workpiece surface 1.1 with a respective contact pressure. The air pressure and consequently the contact pressure are advantageously controllable thus making the removal which depends on the contact pressure controllable during the polishing.

The tool 2 is tilted about a relative angle 3 between the respective surface normal 1.3 of the workpiece 1 and the tool axis 2.2 of the tool. The tilting is carried out about a second axis (not shown) being aligned perpendicular to the tool axis 2.2. The sub figures *a*), *b*) and *c*) show three different phases in the polishing process while the tool 3 is moved along the radius of the workpiece surface 1.1. The relative angle 3 starts at 0° in the center of the workpiece 1 and continuously increases in the course of the motion along the workpiece surface 1.1. The absolute tilting angle 4 of the tool relative to the vertical 5 also increases during the motion but remains small compared to customary polishing methods. A sufficiently curved polishing surface 2.1 provided the shown method enables polishing steep slopes, too.

With a smaller distance of the center of the momentarily contacting surface 2.3 to the rotational axis and tool axis 2.2 the machining surface 2.4 is a circle whose diameter increases with the distance. With a distance bigger than the radius of the contacting surface 2.3 the machining surface 2.4 is an annulus on the polishing surface 2.1.

Figure 4:
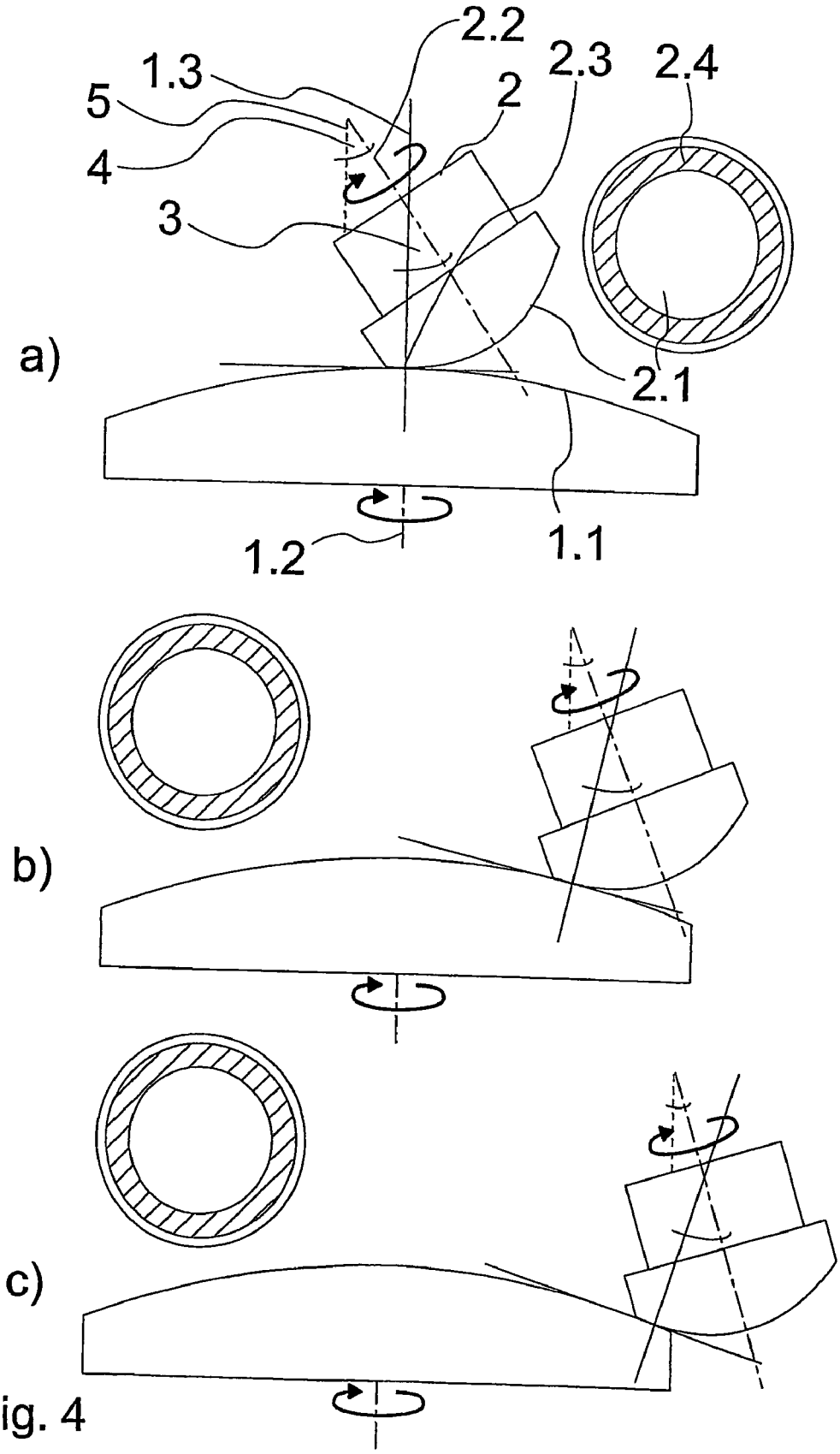
FIGS. 4*a-c* phases of the method with constant relative angle in lateral view as well as schematic diagrams of the polishing surface and the machining surface.

FIG. 4 shows a method in three phases a), b) and c), in which the relative angle 3 remains constant during the whole motion along the workpiece surface 1.1. In this figure and in the following ones the polishing surface 2.1 is also shown in all figures schematically in a bottom view, respectively, whereby the respective machining surface 2.4 is drawn hatched. In this example the machining surface 2.4 remains an annulus constantly due to the constant geometrical circumstances. The absolute tilting angle 4 of the tool to the vertical 5 decreases during the motion; it is maximal in the center of the workpiece 1. With this method, steep slopes can also be polished.

The removal by the tool 2 during the motion along the workpiece surface 1.1 in this example is more uniform than with the continuous modification of the relative angle 3.

Figure 5:
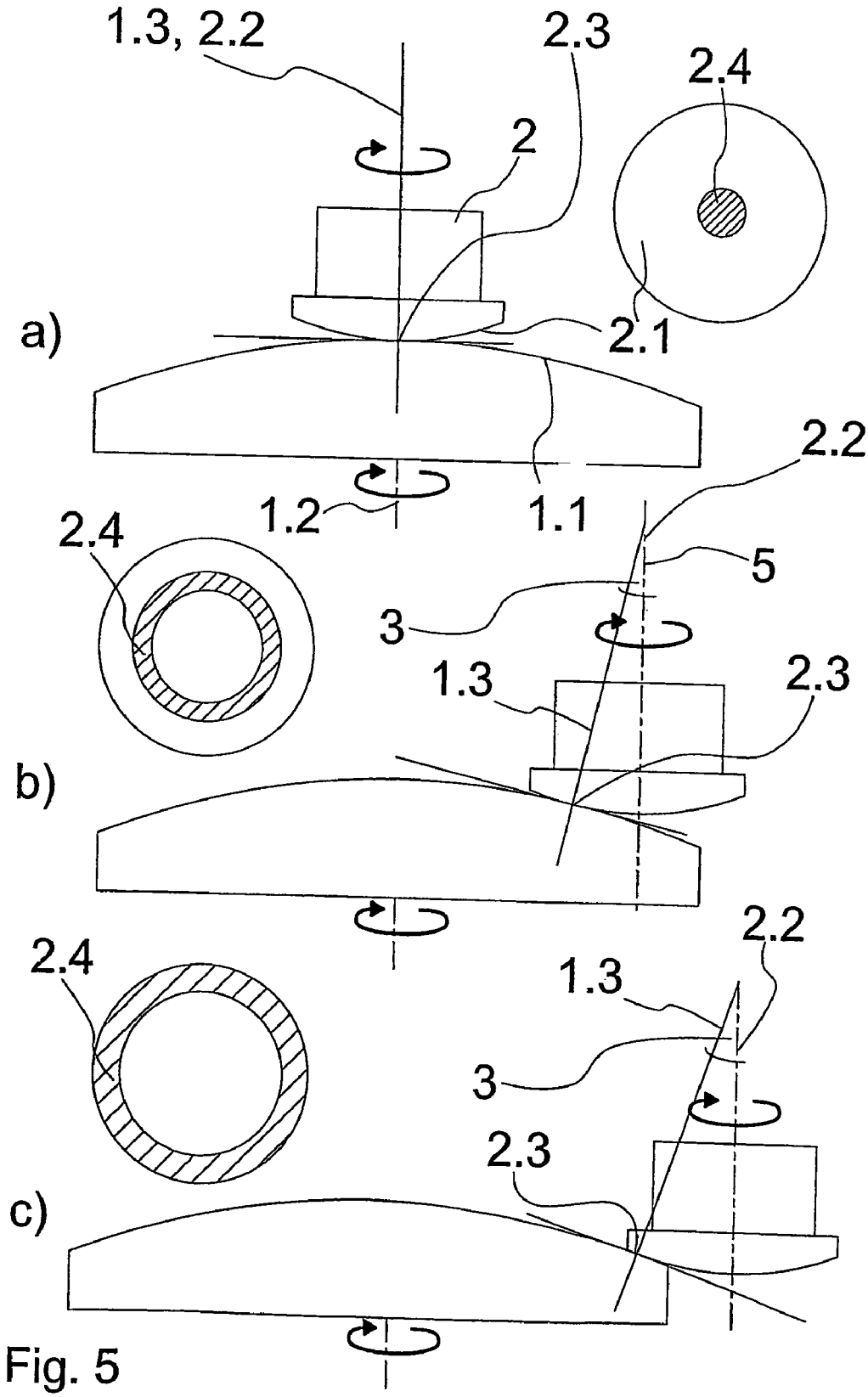
FIGS. 5*a-c* phases of the method with a constant absolute tilting angle to the vertical in lateral view as well as schematic diagrams of the polishing surface and the machining surface.

In the method shown in FIG. 5 the relative angle 3 increases steadily whereas the absolute tilting angle 4 to the vertical 5 is constantly 0°. This motion enables an easy position control of the tool 2. The tool 2 is positioned such that a center point of the contacting surface exhibits the same turning radius as the circle on the workpiece surface 1.1, contacted by it. The machining surface 2.4 changes due to the variable relative angle 3 in a manner similar to the example shown in FIG. 1. It increases depending on the distance of the center point of the momentarily contacting surface 2.3 from the rotational center of the polishing surface 2.1.

Figure 6:
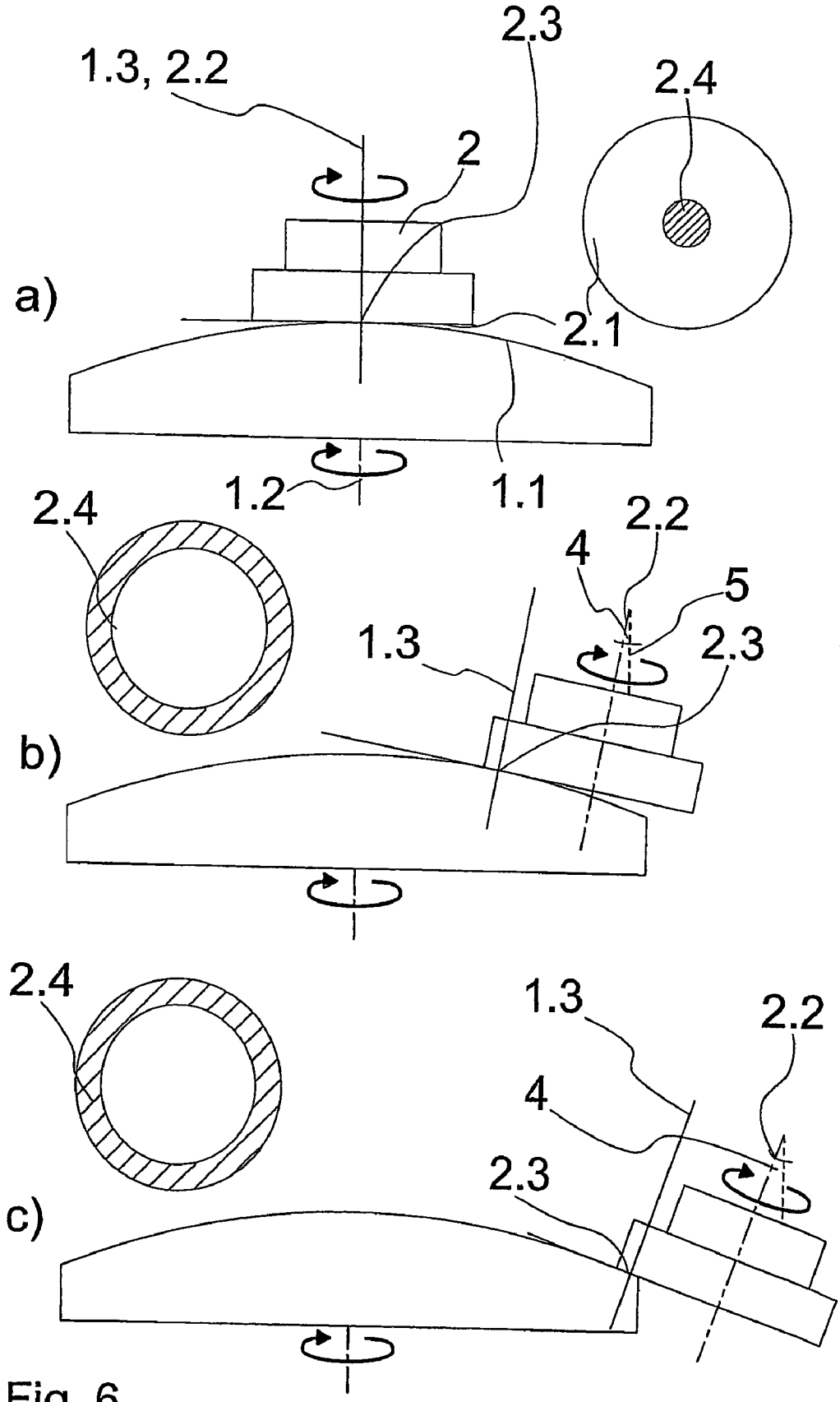
FIGS. 6*a-c* phases of the method with a planar polishing surface at a constant relative angle of 0° in lateral view.

In FIG. 6 a version of the method is shown, in which a tool 2 with a planar polishing surface 2.1 is applied. The situation of the tool 2 is adjusted depending on the position of the tool 2, like in the customary polishing methods, so that the relative angle 3 between the tool axis 2.2 and the local surface normal 1.3 is constantly 0° and the polishing surface 2.1 is thus aligned tangentially to the workpiece surface 1.1. However only the center of the polishing surface is used as the contacting surface 2.4 in the center of the workpiece 1. In the outer areas the tool 2 is translated tangentially to the workpiece surface 1.1 thus accelerating the polishing process or increasing the lifetime of the tool 2 depending on the rotational speed of the tool 2. Polishing with higher precision is possible, too.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A method for polishing a surface of a workpiece via a tool rotating about a tool axis, whereby the workpiece is contacted in at least one region of the workpiece surface by a respective momentarily contacting surface that is a subarea of a surface for machining, which is at least part of a polishing surface of the tool, whereby a tool axis intersects the polishing surface, the method comprising:

adjusting a position of the tool such that a center of the tool's respective surface momentarily contacting the workpiece is off the tool axis, and such that a center of rotation of the polishing surface is spaced from the surface of the workpiece; and tilting the tool about an axis distinct from the tool axis, wherein a relative angle between the tool axis and a local surface normal of the workpiece is adjusted in the contacted area, and wherein the tool is moved translatively along at least a part of the workpiece surface, and wherein a relative angle is being continuously modified at least in sections in the course of the translative motion along the workpiece surface;

wherein a tool with a planar polishing surface is tilted about an axis that is distinct from the tool axis, based on a surface normal of the workpiece in the contacted area, wherein the tool axis is collimated with the surface normal and the tool is parallel translated to a workpiece surface in the contacted area.

2. The method according to claim 1, wherein the amount of the translation is determined based on a removal that is to be achieved.

* * * * *